US006352058B1

(12) United States Patent
Yuasa et al.

(10) Patent No.: US 6,352,058 B1
(45) Date of Patent: Mar. 5, 2002

(54) AIR SCAVENGING TWO-STROKE CYCLE ENGINE

(75) Inventors: Tsuneyoshi Yuasa, Kobe; Isao Yoshimizu; Masanori Kobayashi, both of Akashi, all of (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/570,722

(22) Filed: May 15, 2000

(30) Foreign Application Priority Data

Jun. 4, 1999 (JP) ..... 11-157703

(51) Int. Cl.[7] ..... F01P 7/04
(52) U.S. Cl. ..... 123/73 R; 123/65 R
(58) Field of Search ..... 123/73 R, 184.27, 123/184.52, 585, 73 A, 65 P, 65 R

(56) References Cited

U.S. PATENT DOCUMENTS

| | | | | | |
|---|---|---|---|---|---|
| 4,253,433 | A | * | 3/1981 | Blair | 123/73 R |
| 4,276,858 | A | * | 7/1981 | Jaulmes | 123/73 R |
| 4,362,132 | A | * | 12/1982 | Neuman | 123/73 R |
| 4,469,054 | A | * | 9/1984 | Onishi et al. | 123/73 R |
| 4,474,145 | A | * | 10/1984 | Boyseen | 123/73 R |
| 4,481,909 | A | * | 11/1984 | Takada et al. | 123/73 R |
| 5,031,590 | A | * | 7/1991 | Sakurai | 123/73 R |
| 5,127,373 | A | * | 7/1992 | Mochizuki et al. | 123/73 R |
| 5,934,230 | A | * | 8/1999 | Utydewilligen et al. | 123/73 R |
| 6,216,650 | B1 | * | 4/2001 | Noguchi | 123/73 A |
| 6,230,672 | B1 | * | 5/2001 | Ishibashi et al. | 123/65 P |
| 6,257,179 | B1 | * | 7/2001 | Uenoyama et al. | 123/73 A |

FOREIGN PATENT DOCUMENTS

| | | |
|---|---|---|
| JP | 5-33657 | 2/1993 |
| JP | 9-268918 | 10/1997 |
| JP | 10-121973 | 5/1998 |
| JP | 10-252265 | 9/1998 |

* cited by examiner

*Primary Examiner*—Willis R. Wolfe
*Assistant Examiner*—Jason A Benton
(74) *Attorney, Agent, or Firm*—Oliff & Berridge, PLC

(57) ABSTRACT

It is an object of the invention to provide an air scavenging two-stroke cycle engine capable of smoothly supplying fuel-air mixture into a combustion chamber, reducing the number of parts to thereby reduce cost, and suppressing the blow-by of the fuel-air mixture.

An air scavenging two-stroke cycle engine that introduces fuel-air mixture Introduced into a crank case, through an intake port into a combustion chamber from a first scavenging port, comprising: an air passage; a communicating passage; and a second scavenging port, wherein the second scavenging port is formed in a cylinder such that it is disposed above the intake port and has an upper end higher than an upper end of the first scavenging port, the air passage is connected to the second scavenging port for introducing air through a check valve, and a portion of the air passage that is situated downstream from the check valve communicates with an inside of the crank case through the communicating passage.

3 Claims, 5 Drawing Sheets

AIR SCAVENGING TWO-STROKE CYCLE ENGINE

BACKGROUND OF THE INVENTION

1. Field of the Invention

The present Invention relates to an air scavenging two-stroke cycle engine used as a driving source of a small machine such as a brush cutter.

2. Description of the Related Art

The conventional air scavenging two-stroke cycle engine is shown in FIG. 6 (see Japanese Patent Application Publication No. Hei. 10-121973) FIG. 6 shows a state in which a piston 57 is positioned at a top dead center. This engine is provided with a scavenging block 53 between a cylinder 51 and a crank case 52, in which a plurality of scavenging passages 54 are formed. In a state in which the piston 57 is positioned in the vicinity of a bottom dead center, the plurality of scavenging passages 54 make a combustion chamber 50 in the cylinder 51 and a cylinder head 61 communicate with a crank chamber 52*a* in the crank case 52. These scavenging passages 54 are connected to air passages 55 for introducing air from a portion of an intake passage (not shown) that is situated downstream from an air cleaner. Check valves 56 comprising reed valves for opening or closing openings 55*a* of the air passages 55 that are opened to the scavenging passages 54 are provided on inner surfaces of the scavenging passages 54.

In the engine so configured, a piston 57 in the cylinder 51 moves upward from a bottom dead center, which sequentially closes a scavenging port 54*a* of the scavenging passage 54 that is opened in the combustion chamber 50 and an exhaust port (not shown) to thereby cause an internal pressure of the combustion chamber 50 to be increased and an inside of the crank chamber 52*a* and the scavenging passage 54 to have negative pressures. Thereby, the intake passage (not shown) connected to the crank chamber 52*a* is opened and fuel-air mixture is introduced into the crank chamber 52*a*. Simultaneously, the check valve 56 is opened and air from the air passage 55 is Introduced into the scavenging passage 54.

Just before a top dead center of the piston 57, the fuel-air mixture in the combustion chamber 50 is ignited by an ignition plug 58 and explodes, and then the piston 57 begins to move downward. Along with this downward movement of the piston 57, the exhaust port is first opened and combustion gas in the combustion chamber 50 is then discharged externally to thereby cause the internal pressure of the combustion chamber 50 to be reduced. Then, the scavenging port 54*a* of the scavenging passage 54 is opened. Prior to the fuel-air mixture, the air introduced into the scavenging passage 54 is ejected into the combustion chamber 50 where the internal pressure has been reduced and expels the residual combustion gas inside thereof externally from the exhaust port, to thereby perform initial scavenging operation in the combustion chamber 50 by using the air. In this case, the scavenging air blowing by from the exhaust port is air, and therefore blow-by of the fuel-air mixture hardly occurs. Following this, the fuel-air mixture in the crank chamber 52*a* is introduced through the scavenging passage 54 into the combustion chamber 50, whereby scavenging operation is completed. Thereafter, the above cycle is repeated.

However, in the engine so configured, since the check valve 56 is provided in the scavenging passage 54, there is a possibility that the scavenging air or the fuel-air mixture does not smoothly flow through the scavenging passage 54 into the combustion chamber 50 due to an obstacle such as the check valve 56. In addition, it is necessary to provide the check valves 56 as many as the scavenging passages 54.

Accordingly, the man-hour of assemblies is increased with an increase in the number of the check valves 56 or stoppers thereof and fitting screws, leading to high cost. Further, since the scavenging block 53 is formed separately from the cylinder 51 to allow the check valve 56 to be provided in the scavenging passage 54, the number of parts such as screws or gaskets with which the scavenging block 53 is mounted is increased, also leading to high cost.

In the above configuration, the initial scavenging operation is not necessarily performed in the combustion chamber 50 only by using air. More specifically, although the residual fuel-air mixture in the scavenging passage 54 after a previous scavenging stroke is returned to the crank chamber 52*a* due to the air introduced through the air passage 55, the fuel-air mixture and the air tend to be mixed in the scavenging passage 54 because of small length and large cross-sectional area of the scavenging passage 54. In addition when the air is introduced into the scavenging passage 54, the fuel-air mixture remains in an end portion of the scavenging passage 54, i.e., between the scavenging port 54*a* and the opening 55*a* of the air passage 55. For this reason, the initial scavenging operation is performed in the combustion chamber 50 by using the air including the fuel-air mixture, and the fuel-air mixture blows by from the exhaust port.

Another example of the air scavenging two-stroke cycle engine is described in Japanese Patent Application Publication No. Hel. 9-268918. In this engine, an air passage is connected to a scavenging passage through which the fuel-air mixture is introduce into the combustion chamber, and the air is ejected into the combustion chamber from the scavenging port. In this case, it is also necessary to provide the check valves as many as the scavenging passages at connected portions of the scavenging passages and the air passages. Therefore, the number of parts is increased. In addition, the air and the fuel-air mixture are mixed in the scavenging passages, and therefore the initial scavenging operation cannot be performed only by using air.

SUMMARY OF THE INVENTION

In consideration of such circumstances, it is an object of the present invention to provide an air scavenging two-stroke cycle engine which is capable of smoothly supplying fuel-air mixture from a crank case into a combustion chamber, reducing the number of parts to thereby reduce the man-hour of assemblies and cost, and performing scavenging operation only by using air in the initial stage of the scavenging stroke to suppress blow-by of the fuel-air mixture from an exhaust port, in order to realize high fuel efficiency and reduction of concentration of HC emission.

In an aspect of the present invention, an air scavenging two-stroke cycle engine that introduces fuel-air mixture introduced into a crank case provided on a lower portion of a cylinder through an intake port into a combustion chamber in an upper portion of the cylinder from a first scavenging port and discharges a combustion gas externally from a discharge port, by up and down movement of a piston in the cylinder, comprises: an air passage; a communicating passage; and a second scavenging port, wherein the second scavenging port is formed in the cylinder such that it is disposed above the intake port and has an upper end higher than an upper end of the first scavenging port and lower than an upper end of the discharge port, the air passage is connected to the second scavenging port for introducing air through a check valve, and a portion of the air passage that is situated downstream from the check valve communicates with an inside of the crank case through a communicating passage.

In the engine so configured, in a scavenging stroke, scavenging operation is firstly performed by using air such that the second scavenging port is opened, scavenging air filled in the communicating passage is ejected into the combustion chamber, and then combustion gas in the combustion chamber is expelled externally from the exhaust port. Following this, the first scavenging port is opened and fuel-air mixture in the crank case is thereby introduced into the combustion chamber, whereby scavenging operation is completed.

When the scavenging operation performed in the combustion chamber by using the air is completed, the fuel-air mixture is tilled in a region of the communicating passage, corresponding to a region from the crank case to the vicinity of the second scavenging port. A part of this filled fuel-air mixture is pushed back into the crank case by air introduced into the communicating passage from the air passage when the check valve is opened in an intake stroke, and the residual remains in the communicating passage closer to the crank case as being separated from the air. At this time, a portion of the fuel-air mixture which has not been pushed back by the air might remain in the air passage in vicinity of the second scavenging port. However, if a portion where the communicating passage is connected to the air passage is formed closer to the second scavenging port, then the fuel-air mixture in the vicinity of the second scavenging port is sucked into the communicating passage by suction force of the air flowing into the communicating passage, and no residual of the fuel-air mixture occurs. Therefore, in an initial stage of scavenging operation, only the air in the communicating passage is ejected into the combustion chamber from the second scavenging port and, by using this air, scavenging operation is performed in the combustion chamber. For this reason, blow-by of the fuel-air mixture is suppressed. As a result, high fuel efficiency is achieved and concentration of HC emission is reduced.

In addition, in this engine, no obstacle such as the check valve is provided in the first scavenging passage connecting the crank case and the combustion chamber, and therefore the fuel-air mixture in the crank case is smoothly supplied from the first scavenging port into the combustion chamber. Further, the number of parts is reduced and cost is correspondingly reduced.

Preferably, the second scavenging port is disposed at a position opposite to the exhaust port in a diameter direction of the cylinder. With this configuration, since the air from the second scavenging port travels transversely across the combustion chamber toward the exhaust port, the combustion gas is quickly scavenged. As a result, scavenging efficiency is improved.

Preferably, the second scavenging port is opened to be directed obliquely upward so that it supplies air along a convexly curved upper surface of the piston. With this configuration, the air smoothly flows along the upper surface of the piston, and therefore the scavenging efficiency of the combustion gas scavenged by using the air from the second scavenging port is further improved.

Preferably, a part of the communicating passage is constituted by a connecting pipe disposed externally of the engine. With this configuration, sufficient length of the communicating passage is ensured for a small engine. Therefore, the air introduced into the communicating passage is prevented from going into the crank case and being mixed with the fuel-air mixture. Further, the communicating passage is made narrower while keeping the volume of the air required for scavenging operation. In other words, since the passage area (a cross-sectional area of the passage) is made smaller, it hardly occurs that the air and the fuel- air mixture pushed back to the crank case side by the air are mixed in the communicating passage, that is, they are separated from each other satisfactorily. Accordingly, in the initial stage of the scavenging operation, only the air is ejected from the second scavenging port through the communicating passage for scavenging operation in the combustion chamber.

This object, as well as other objects, features and advantages of the invention will become more apparent to those skilled in the art from the following description taken with reference to the accompanying drawings.

DETAILED DESCRIPTION OF THE PREFERRED EMBODIMENTS

Hereinafter, a preferred embodiment of the present invention will be described with reference to drawings.

Figure 1:
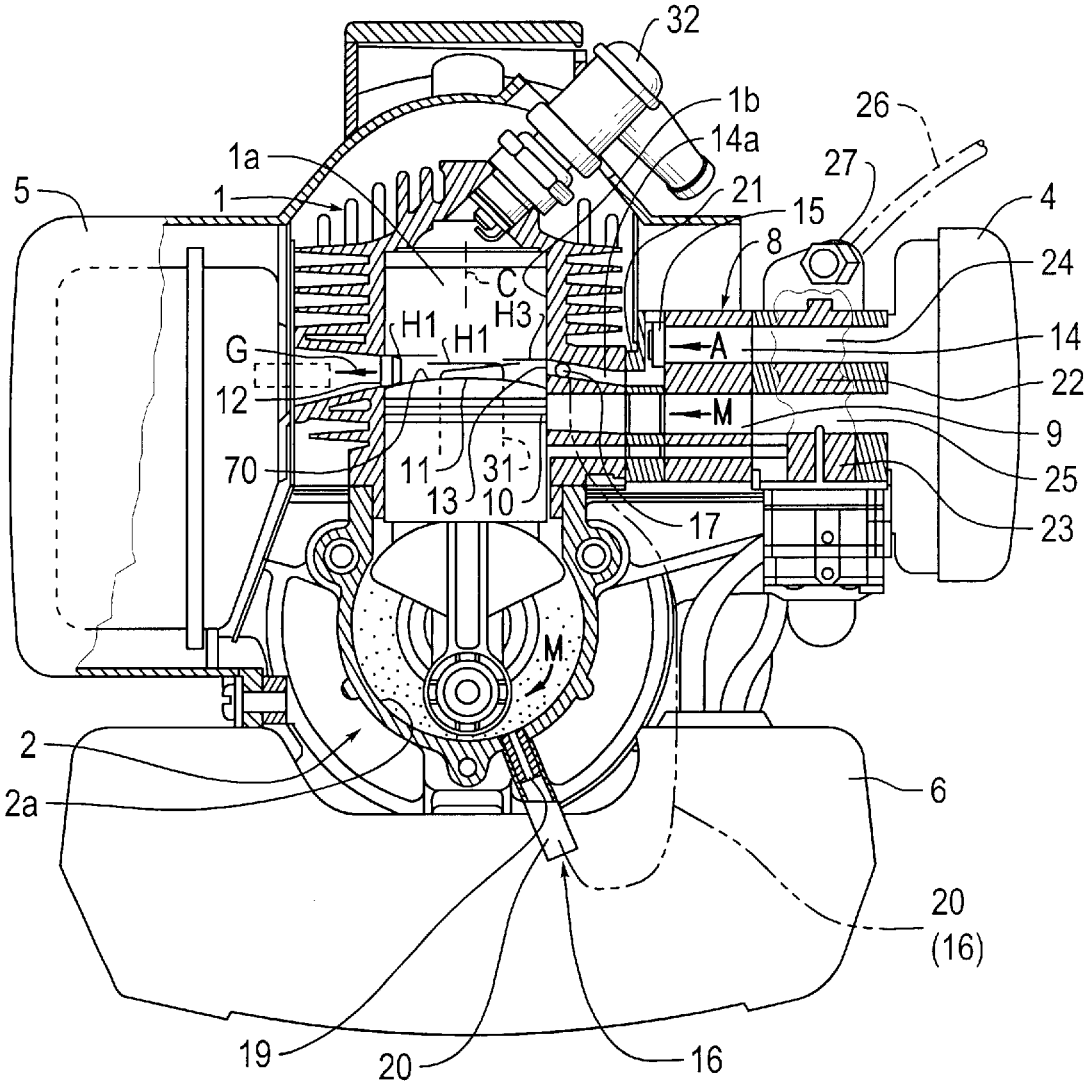
FIG. 1 is a partially cutaway front view showing an embodiment of an engine according to the present invention.

Referring now to FIG. 1, an air scavenging two-stroke cycle engine according to an embodiment of the present invention is used for a brush cutter, for example. In FIG. 1, a state in which a piston 7 in a cylinder 1 is positioned at a bottom dead center is illustrated. In the Figure, the cylinder 1 which has a combustion chamber 1*a* therein is connected to an upper portion of a crank cane 2. A carburetor 3 and an air cleaner 4 constituting an intake system are connected to one side of the cylinder 1 and a muffler 5 constituting an exhaust system is connected to the other side thereof. A fuel tank 6 is mounted on a lower portion of the crank case 2. The piston 7 is adapted to reciprocate axially (up and down) in the cylinder 1.

An adapter 8 is provided between the cylinder 1 and the carburetor 3. The cylinder 1, the carburetor 3, and the adapter 8 have an intake passage 9 inside thereof, and an intake port 10 at an outlet end of the intake passage 9 is opened in a cylindrical portion 1*b* of the cylinder 1 on which the piston 7 slides. A first scavenging port 11 communicating with a crank chamber 2*a* in the crank case 2 through a scavenging passage 31 is formed at a position in the cylindrical portion 1*b* above the intake port 10. An exhaust port 12 having an upper end thereof higher than that of the first scavenging port 11 and communicating with the muffler S is formed in the cylindrical portion 1*b*.

Figure 2:
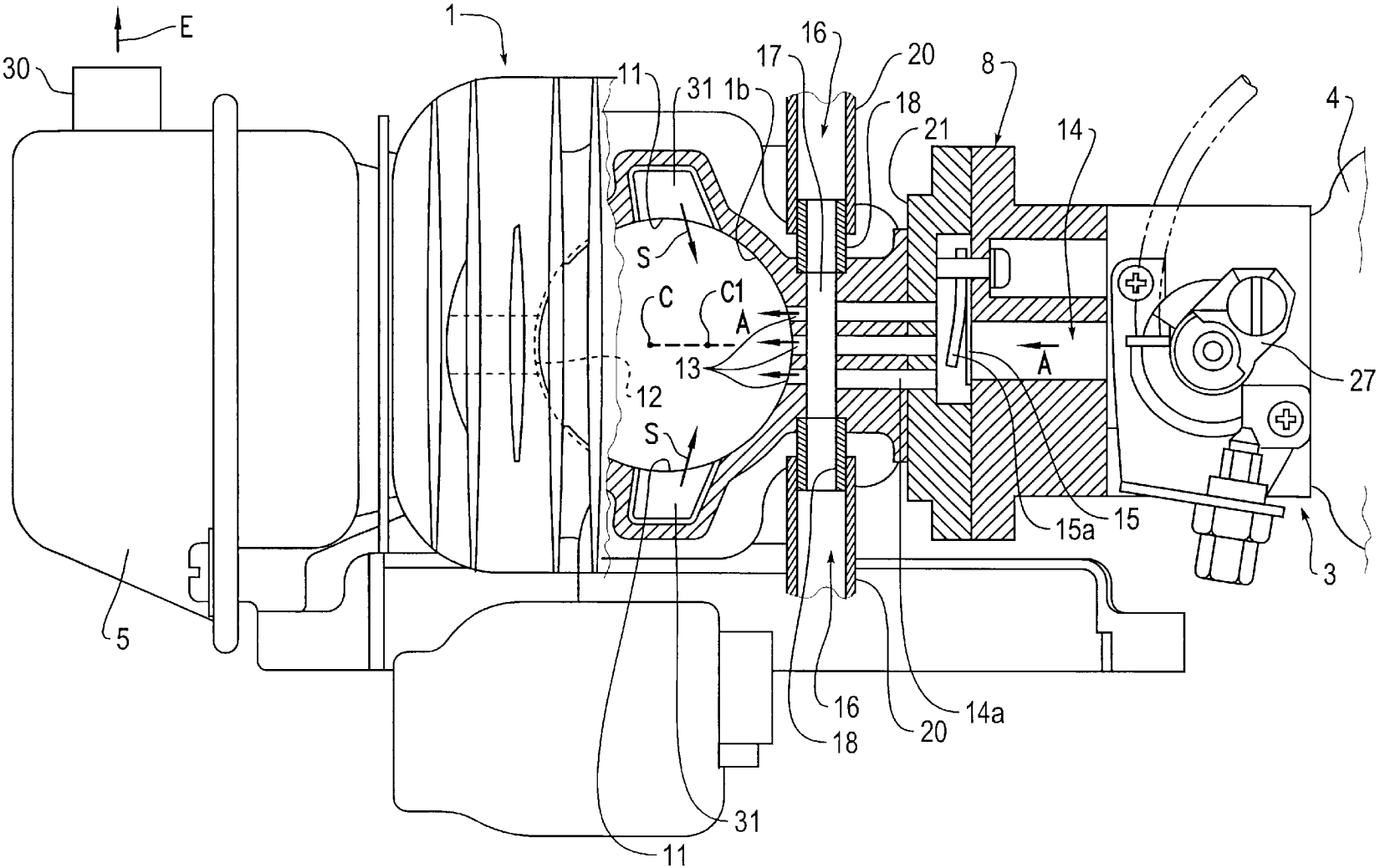
FIG. 2 is a partially cutaway plan view of the engine.

A second scavenging port 13 having an upper end thereof higher than that of the first scavenging port 11 and lower than that of the exhaust port 12 is opened in the cylindrical portion 1*b*. Assuming that upper end positions of the exhaust port 12, the first scavenging port 11, and the second scavenging port 13 are H1, H2, and H3, respectively, the heights of them are decreased in the order of H1, H3, and H2. As shown in FIG. 2, two first scavenging ports 11 are provided opposite to each other backward and forward and are opened toward a position C1 deviating in a direction opposite to the exhaust port 12 from a center line C of the combustion chamber 1*a* so that scavenging air S is ejected in the direction away from the exhaust port 12. That is, the first scavenging port 11 is directed toward the position C1.

Three second scavenging ports 13 are arranged side by side on a side portion of the cylindrical portion 1*b* of the cylinder 1. The second scavenging ports 13 communicate with downstream from a cleaner element of the air cleaner 4 through an air passage 14 passing through a wall portion of the cylinder 1, the adapter 8 and the carburetor 3. The scavenging ports 13 are provided opposite to the exhaust port 12 in a diameter direction of the cylindrical portion 1*b* and are opened obliquely upward toward the center line (center line of the cylindrical portion 1*b*) C of the combustion chamber 1*a* so that the air A is supplied along a convexly curved upper surface 70 of the piston 7 shown in FIG. 1.

As shown in FIG. 2, a check valve 15 comprising a reed valve for opening or closing the air passage 14 to permit the flow of the air A toward downstream and to prevent the reversed flow toward upstream is provided inside the adapter 8. Downstream of the check valve 15, three branching passages 14*a* constituting a part of the air passage 14 and being opened in the second scavenging ports 13, respectively, are formed in a part of the adapter 8 and the cylinder 1. While three branching passages are provided, one, two, four or more branching passages 14*a* may be provided. In the Figure, reference numeral 15*a* denotes a stopper of the check valve 15.

Figure 3:
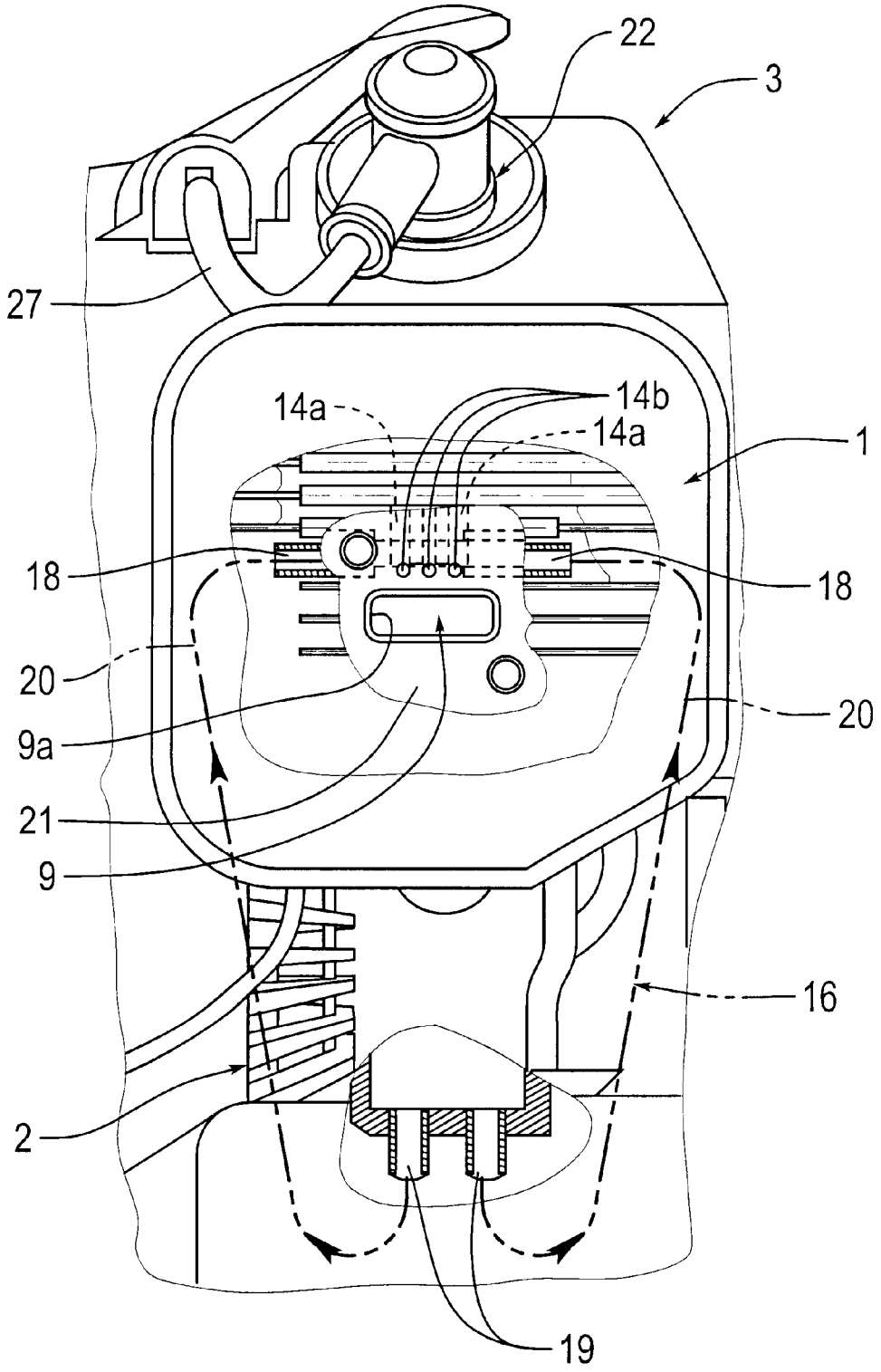
FIG. 3 is a partially cutaway right side view of the engine.

A communicating passage 16 is formed between a portion of the air passage 14 that is situated downstream from the check valve 15 and the crank chamber 2*a*. A connecting hole 17 constituting a part of the communicating passage 16 is formed in a direction orthogonal to each of the branching passages 14*a* and cross the each of the branching passages in the vicinity of the cylindrical portion 1*b*. Cylindrical connecting members 18 are attached to both sides of the connecting hole 17 backward and forward. As shown in FIG. 3, cylindrical connecting members 19 are attached to both sides of a lower portion of the crank chamber 2*a*. Connecting pipes 20 provided externally of the engine and forming a part of the communicating passage 16 connect these connecting members 18 and 19 to each other. In this embodiment, the connecting pipe 20 forms a main part of the communicating passage 16 as having a length more than half of the length of the communicating passage 16. The communicating passage 16 is thus constituted of the connecting hole 17, the connecting members 18 and 19, and the connecting pipe 20. In FIG. 2, reference numeral 21 denotes a gasket interposed between the cylinder 1 and the adapter 8. Three holes 14*b* shown in FIG. 3 constituting parts of respective branching passages 14*a* are formed in an upper portion of the gasket 21 and a rectangular hole 9*a* constituting a part of the intake passage 9 is formed in a lower portion of the gasket 8.

Figure 4:
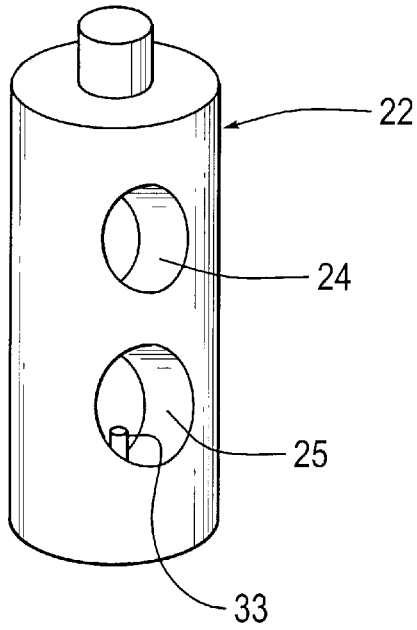
FIG. 4 is a longitudinal sectional view of a rotary valve.

The carburetor 3 shown in FIG. 1 is provided with a rotary throttle valve 22 for simultaneously controlling supply volumes of the fuel-air mixture M and the air A such that its axis is directed vertically. As shown in FIG. 4. the rotary throttle valve 22 has an air hole 24 and an intake hole 25 that are axially spaced apart from each other. That is, a cylindrical valve body 23 of the throttle valve 22 has the air hole 24 forming a part of the air passage 14 in an upper portion thereof and the intake hole 25 forming a part of the intake passage 9 in a lower portion thereof. The air hole 24 and the intake hole 25 respectively penetrate through the valve body 23 in a diameter direction thereof. A main nozzle 33 for ejecting fuel from the lower portion of the carburetor 3 (FIG. 1) into the intake hole 25 is provided in the intake hole 25.

A throttle lever provided on the brush cutter is operated to drive a throttle arm 27 mounted on the carburetor 3 via connecting means 26 such as wire shown in FIG. 1 to thereby rotate the rotary valve 22 connected to the throttle arm 27 around the axis thereof. Thereby, opening areas of the intake hole 25 and the air hole 24 with respect to the intake passage 9 and the air passage 14, respectively, that is, passage areas are simultaneously adjusted to thereby control the volume of the fuel-air mixture and the volume of the air going through the passages 9 and 14 into the crank chamber 2*a*. The fuel-air mixture more than the air is required when operating the engine, and the intake hole 25 is therefore made larger than the air hole 24.

Operation of the engine so configured will now be described.

Referring to FIG. 1 again, when the piston 7 in the cylinder 1 moves upward from a bottom dead center (compression stroke), the first scavenging port 11, the second scavenging port 13, and the exhaust port 12 are sequentially closed, which causes the internal pressure in the combustion chamber 1*a* to be increased and the crank chamber 2*a* to have a negative pressure. Then, the communicating passage 16 communicating with the crank chamber 2*a* and the air passage 14 connected to the communicating passage 16 are brought into negative pressure states, causing the check valve 15 to be opened. Thereby, the air A from the air cleaner 4 is introduced into the communicating passage 16 through the air passage 14 to fill a part or all of the inside of the connecting pipe 20. When the piston 7 further moves upward and the intake port 10 is opened, the fuel-air mixture M from the carburetor 3 is introduced through the intake passage 9 into the crank chamber 2*a*.

Around the top dead center of the piston 7, the fuel-air mixture in the combustion chamber 1*a* is ignited by the ignition plug 32 and explodes, and then the piston 7 begins to moves downward(expansion stroke). Along with this downward movement of the piston 7, the exhaust port 12 of the cylinder 1 is opened and the combustion gas G in the combustion chamber 1*a* is discharged through the exhaust port 12 into the muffler 5 provided outside of the cylinder. Thereby, the internal pressure in the combustion chamber 1*a* is reduced to some degrees. Subsequently, a scavenging stroke in which the second scavenging port 13 and the first scavenging port 11 are opened starts. First, the second scavenging port 13 is opened. At this time, because the pressure in the crank chamber 2*a* is significantly increased due to the downward movement of the piston 7, the pressure in the communicating passage 16 and the pressure in the branching passage 14*a* are correspondingly increased, which causes the check valve 15 to be closed. The air A filled in the connecting pipe 20 is ejected into the combustion chamber 1*a* where the internal pressure has been reduced and expels the combustion gas G in the combustion chamber through the exhaust port 12 into the muffler 5, whereby scavenging operation is performed in the combustion chamber 1*a* by using the air.

At this time, the air A from each of the scavenging ports 13 is ejected toward the exhaust port 12 in such a manner that the air traverses across the combustion chamber 1*a* in a diameter direction of the cylinder along the curved upper surface 70 of the piston 7 from a position opposite to the exhaust port 12. For this reason, the combustion gas G remaining in the combustion chamber 1*a* is quickly scavenged in the initial stage of the scavenging stroke, resulting in improved scavenging efficiency. The combustion gas G discharged into the muffler 5 is muffled therein. An exhaust gas E having reduced temperature is discharged externally from an exhaust pipe 30 provided on a rear surface of the muffler 5 shown in FIG. 2.

After the above scavenging operation by using the air A, the fuel-air mixture M in the crank chamber 2*a*, following the scavenging air A, is filled in the vicinity of the second scavenging port 13 in the communicating passage 16. Thereafter, the pressure in the crank chamber 2*a* is reduced due to the upward movement of the piston 7 described above, so that the fuel-air mixture M is sucked into the communicating passage 16. A part of the fuel-air mixture M is returned to the crank chamber 2*a* and the residual remains in the communicating passage 16. Following this, the cheek valve 15 is opened because of further reduced pressure in the crank chamber 2*a*, and air from the air passage 14 is introduced into the communicating passage 16 and sucked into the crank case 2*a*. Therefore, a portion of the communicating passage 16 that is closer to the second scavenging port 13 is filled with air.

There is a possibility that the fuel-air mixture M which has not been pushed back by the air A remains in the communicating passage 16 in vicinity of the second scavenging port 13, i.e., in the branching passage 14*a* between the second scavenging port 13 and the connecting hole 17. In this case, however, if the connecting hole 17 connecting the air passage 14 and the communicating passage 16 is formed closer to the second scavenging port 13, then suction force exerted on the fuel-air mixture M by the air A flowing into the communicating passage 16 increases, and therefore, the fuel-air mixture H in the vicinity of the second scavenging port 13 is sucked into the communicating passage 16 and fuel-air mixture hardly remains therein. If any, the volume of the residual fuel-air mixture is very small.

The connecting pipe 20 extends externally of the engine from an intermediate height position of the cylinder 1 to a bottom position of the crank case 2. Therefore, the sufficiently long communicating passage 16 is ensured even in the case of the small engine. For this reason, the air A introduced into the passage 16 is prevented from flowing into the crank chamber 2*a* and being mixed with the fuel-air mixture M. Further, the communicating passage 16 can be made narrower, that is, its passage area can be made smaller while keeping the volume of the air necessary for scavenging operation in the communicating passage 16. So, it hardly occurs that the air A and the fuel-air mixture M pushed back into the crank chamber 2*a* by the air A are mixed in the communicating passage 16. That is, they are separated from each other satisfactorily. Accordingly, in the initial stage of the scavenging operation, only the air A is ejected from the second scavenging port 13 through the communicating passage 16 for scavenging operation in the combustion chamber 1*a*. As a result, the blow-by of the fuel-air mixture N is reliably suppressed to thereby achieve high fuel efficiency and reduce concentration of HC emission.

When the piston 7 further moves downward and the first scavenging port 11 is opened, the fuel-air mixture M in the crank chamber 2*a* is introduced from the first scavenging port 11 into the combustion chamber 1*a* through the scavenging passage 31. The fuel-air mixture expels the residual combustion gas G toward the exhaust port 12 while colliding against the inner wall of the combustion chamber 2*a* around the second scavenging port 13 and turning its direction, whereby scavenging operation is completed. No obstacle such as the check valve is provided in the scavenging passage 31, and therefore, the fuel-air mixture in the crank chamber 2*a* is smoothly supplied from the first scavenging port 11 into the combustion chamber 1*a*.

When operating the engine, the throttle lever is operated to rotate the rotary valve 22. Thereby, the opening areas of the intake hole 25 and the air hole 24 with respect to the intake passage 9 and the air passage 14 are adjusted to simultaneously control supply volumes of the fuel-air mixture M and the air A reaching the crank chamber 2*a* from the passages 9 and 14 both in high speed operation and in low speed operation.

Figure 5:
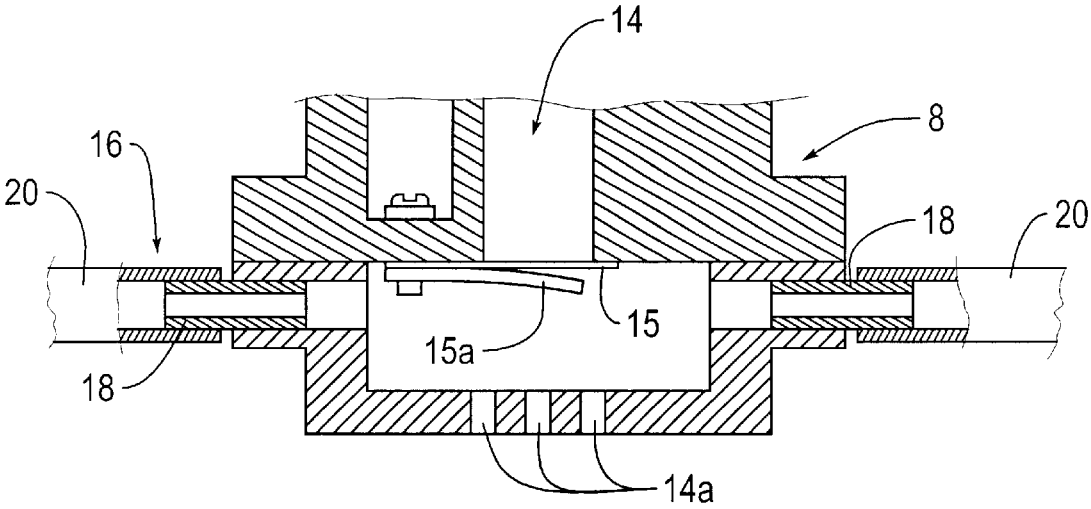
FIG. 5 is a cross-sectional view showing a modification of a communicating passage.
Figure 6:
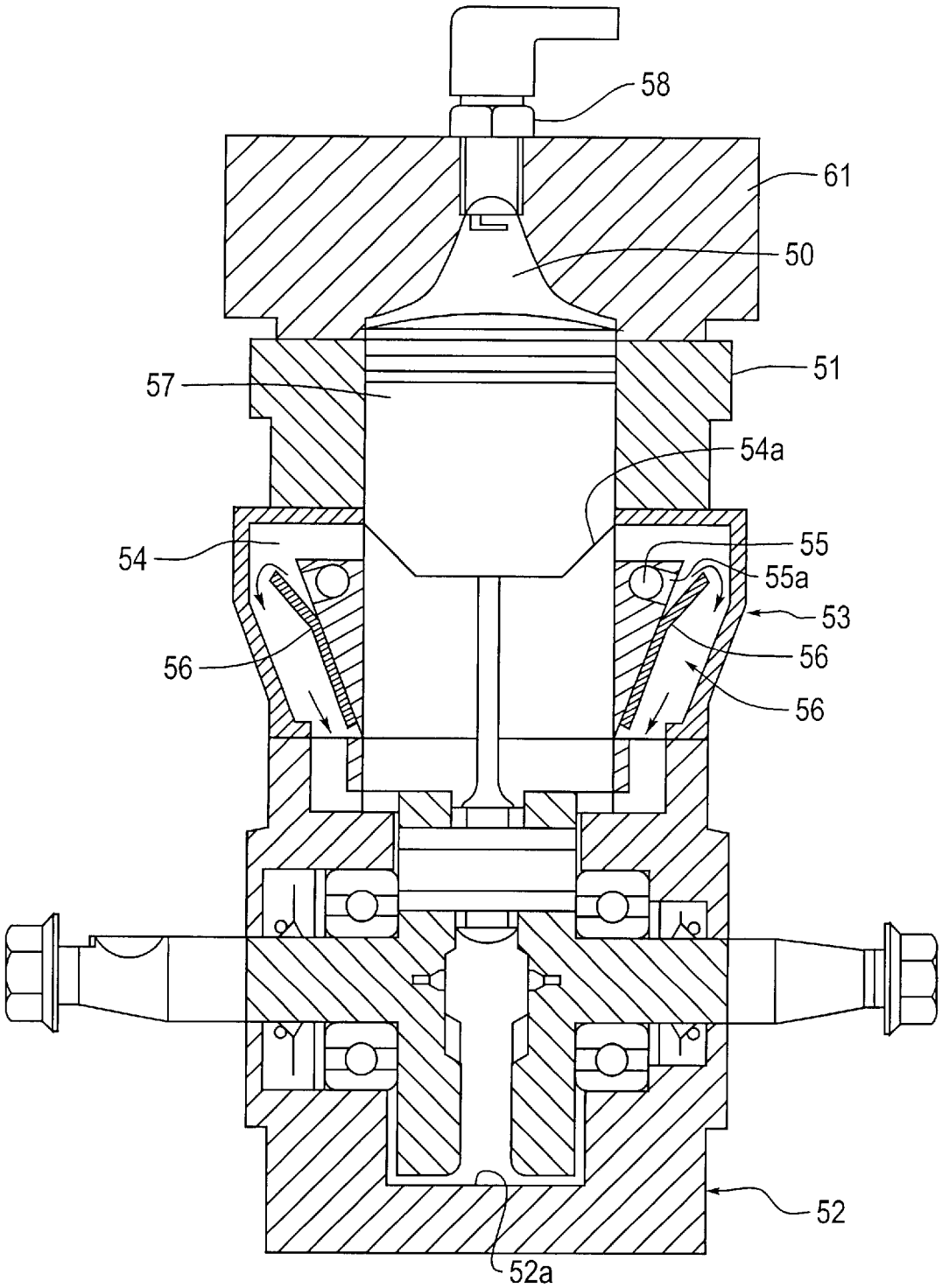
Fig. 6 PRIOR ART
FIG. 6 is longitudinal sectional view showing a conventional engine.

FIG. 5 shows a modification of how the communicating passage 16 is connected to the adapter 8. In FIG. 5, a cylindrical connecting member 18 is mounted on a side portion of the adapter 8 downstream from the check valve 15 such that it communicates with the air passage 14, and an upper end portion of the connecting pipe 20 constituting a main part of the communicating passage 16 is connected to the connecting member 18.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

What is claimed is:

1. An air scavenging two-stroke cycle engine that introduces fuel-air mixture introduced into a crank case provided on a lower portion of a cylinder into a combustion chamber in an upper portion of the cylinder from a first scavenging port and discharges a combustion gas externally from an exhaust port, by up and down movement of a piston in the cylinder, comprising:

an intake port through which the fuel-air mixture is introduced into the crank case;

a second scavenging port formed in the cylinder such that the second scavenging port is positioned above the intake port and opposite to the exhaust port in a diameter direction of the cylinder and has an upper end higher than an upper end of the first scavenging port;

an air passage that communicates with the second scavenging port, for taking; only air externally of the engine;

a check valve provided in the air passage to permit flow of the taken-in air toward the second scavenging port; and a communicating passage that makes a portion of the air passage that is situated downstream of the check valve and close to the second scavenging port and the crank case communicate with each other and has a main part comprising a connecting pipe placed externally of the engine.

2. The air scavenging two-stroke cycle engine of claim 1, wherein a portion of the air passage extending from the check valve to openings into the cylinder comprises a plurality of branching passages with which the communicating passage communicate, and the openings of the plurality of branching passages into the cylinder constitute the second scavenging port.

3. The air scavenging two-stroke cycle engine of claim 1, wherein the second scavenging port is opened to be directed obliquely upward so that it supplies air along a convexly curved upper surface of the piston.

* * * * *